US005581043A

United States Patent [19]

Bowar

[11] Patent Number: 5,581,043

[45] Date of Patent: Dec. 3, 1996

[54] OVERTONE ENHANCING MUSICAL INSTRUMENT

[76] Inventor: Richard D. Bowar, 1305 Navajo Trail, Alabaster, Ala. 35007

[21] Appl. No.: 605,557

[22] Filed: Feb. 20, 1996

[51] Int. Cl.[6] ..... G10D 3/00

[52] U.S. Cl. ..... 84/291; 84/294

[58] Field of Search ..... 84/270, 275, 291, 84/294, 267

[56] References Cited

U.S. PATENT DOCUMENTS

| | | | |
|---|---|---|---|
| D. 161,075 | 12/1950 | Alkire . | |
| 2,535,252 | 12/1950 | Alkire | 34/267 |
| 4,172,404 | 10/1979 | Dopyera | 84/291 |
| 4,206,678 | 6/1980 | Guerrero | 84/267 |
| 4,539,887 | 9/1985 | Bjerkas | 84/314 |
| 5,355,756 | 10/1994 | Geiger | 84/270 |
| 5,497,688 | 3/1996 | Ruiz-carrero | 84/291 |

*Primary Examiner*—Patrick J. Stanzione
*Attorney, Agent, or Firm*—Wm. Randall May

[57] ABSTRACT

An acoustical instrument designed to promote and enhance the production of musical overtones is disclosed. The instrument is capable of reinforcing, and thereby enhancing, the resonance of naturally produced musical overtones and can be adjusted to fine tune the overtone frequency of the instrument to ambient atmospheric conditions. Adjustment baffles within the tone box of the instrument enable the user to change or adjust the wavelength of the music produced by the instrument to more closely coincide with the overtone transmission capability of the ambient environment. Strings of specific length, diameter and placement are used to achieve optimal production, enhancement and transmission of overtones with the device.

10 Claims, 3 Drawing Sheets

OVERTONE ENHANCING MUSICAL INSTRUMENT

BACKGROUND OF THE INVENTION

This invention relates generally to stringed musical instruments of the acoustical type. More specifically, this invention relates to a modified ten string guitar, the design and construction of which allows for the enhancement of musical overtones produced by the instrument.

Stringed musical instruments produce sound by vibrations that occur when the strings are plucked or strummed. The vibrating strings in turn cause parts of the body of the instrument to vibrate, all of which sets the surrounding air into motion. While each string vibrates over its entire length, it also vibrates in segments which are shorter than the total length of the string. Each vibrating segment produces a separate tone, called an overtone. The first overtone or harmonic of a note is known as the fundamental and results from the vibration of the whole string. The fundamental is also the lowest tone of an overtone series. Almost every musical sound consists of a combination of the actual note sounded, or the fundamental, and a number of higher tones related to, or in sympathy with, the fundamental note. The higher tones are overtones of the fundamental. For example, when a note is produced by a guitar string, the string vibrates as a whole and produces the fundamental tone. But the string also vibrates in separate sections at the same time and may vibrate in two, three, four or more parts. Each of these vibrations produces an overtone of higher frequency and pitch than the fundamental. The greater the number of vibrating parts is, the higher will be the frequency of the overtone. The number and strength of the overtones help determine the overall sound quality of the instrument. Sounds with strong harmonics or overtones are often called resonant or rich in quality, and sounds with relatively weak overtones are often called muted sounds. Ambient conditions such as temperature, pressure and humidity also affect the sound quality, or timbre, of stringed instruments, especially acoustic instruments. These atmospheric conditions also directly affect the ability of the instrument to transmit overtones through the surrounding air to be heard or recorded. It is known that overtone frequencies can and will expand and contract depending on these environmental factors and changes thereto.

An instrument which is capable of amplifying the resonance of musical overtones and which can be adjusted to fine tune the overtone frequency of the instrument to ambient atmospheric conditions would be highly desirable.

SUMMARY OF THE INVENTION

In view of the foregoing, it is a primary object of this invention to provide an overtone enhancing acoustical instrument having features which allow the instrument to be tuned or adjusted to ambient atmospheric conditions in order to amplify or enhance the effect of musical overtones produced by the instrument.

According to an embodiment of the invention, a modified ten string acoustic guitar comprises strings of specific length, diameter, placement and key, and a tone box having adjustable baffles for fine tuning the instrument to ambient conditions.

It is an object of the present invention to provide an acoustical instrument which, through its design and construction, utilizes and enhances the resonant quality of natural harmonics, more so than any other known instrument, to produce harp-like music rich in musical overtones. When properly keyed and adjusted, the present invention literally "bathes" the user and listener in an array of enhanced musical overtones and harmonics.

An important advantage of the present invention resides in the special placement, length and diameter of each string which, in combination, serves to enhance, reinforce, and promote the production of overtones during play.

Another important advantage of the present invention is the provision of a modified acoustic guitar having features which enable the instrument, through the use of its adjustable tone box baffles, to change or adjust the wavelength of the music produced by the instrument to more closely coincide with the overtone transmission capability of the ambient environment.

A further advantage of the present invention is that the device is easy to play and can be used with standard classical guitar strings readily available in most music stores.

Yet another advantage of the present invention is the ability of the device to produce soft, rich, relaxing commercial quality sound particularly suitable for church worship services or for professional or institutional purposes where patient or client relaxation is desired.

Finally, the invention is particularly advantageous in that its unique features allow the user of the instrument to compensate for the expansion and contraction of the overtone transmission ability or capability of the environment caused by changes in ambient conditions such as temperature, humidity and pressure.

BRIEF DESCRIPTION OF THE DRAWINGS

The foregoing and other objects, features, and advantages of the present invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

DETAILED DESCRIPTION OF THE DRAWINGS

Figure 1:
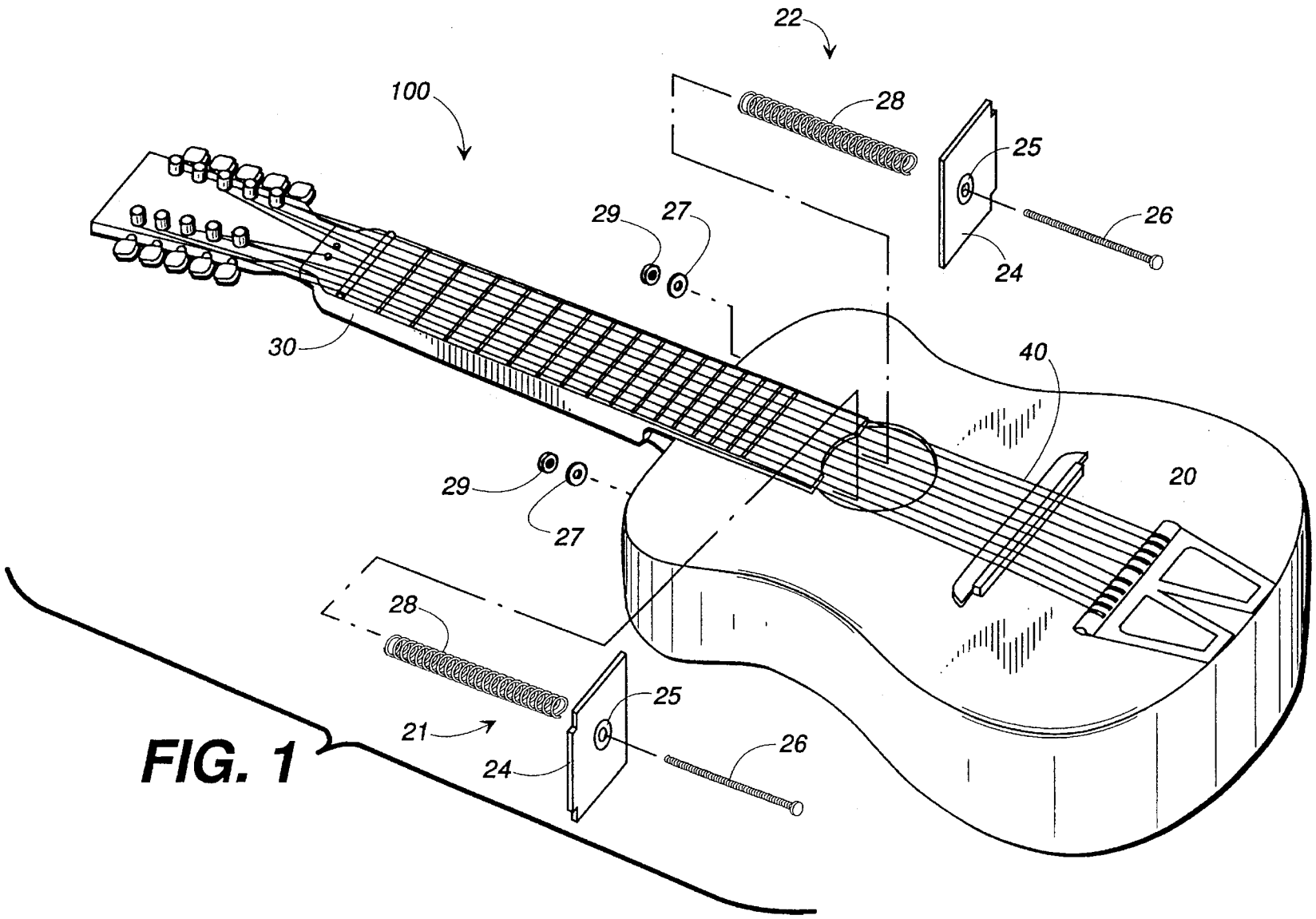
FIG. 1 is a perspective view of an embodiment of the invention with an exploded view of the adjustable tone box baffles of the device.

In accordance with an embodiment of the invention, FIG. 1 shows a modified acoustic guitar 100 comprising a tone box 20 having adjustable baffles 21 & 22, an elongated fingerboard 30 and a plurality of strings 40 of specific length, diameter and placement.

Figure 2:
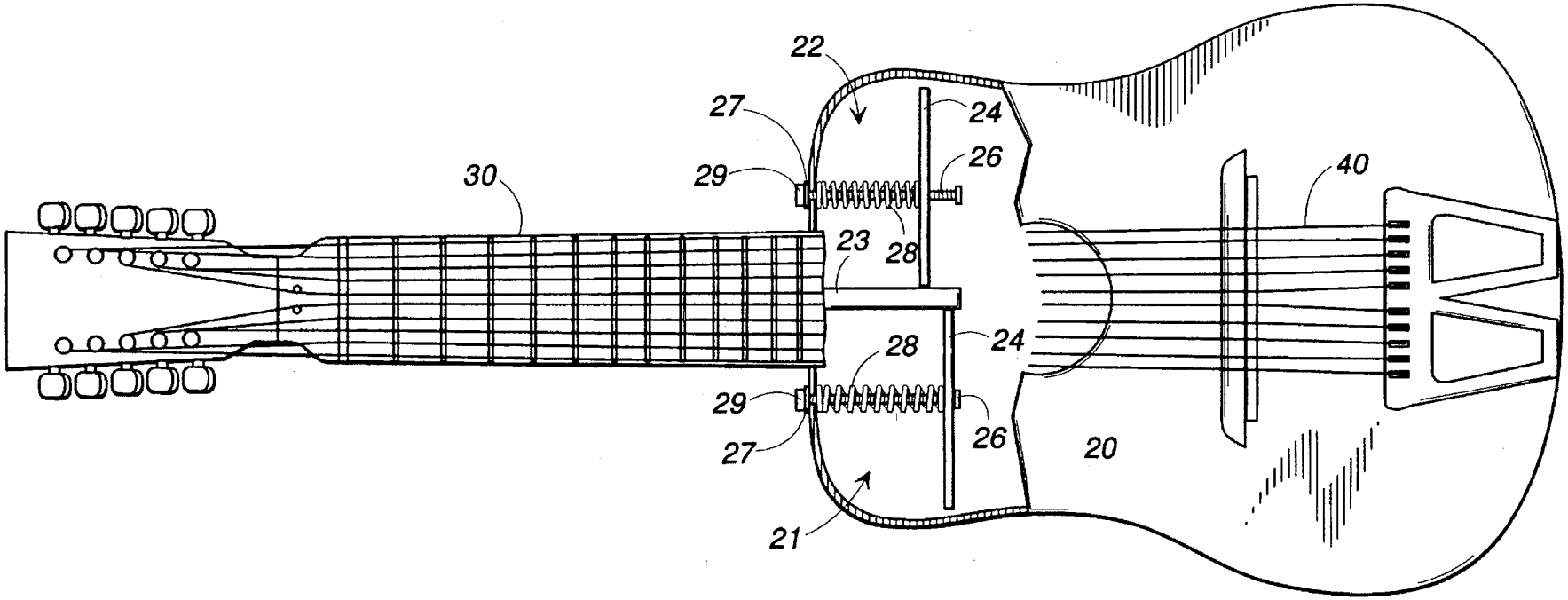
FIG. 2 is a plan view, partially sectioned, of the embodiment of FIG. 1 showing the adjustable tone box baffles installed within the tone box of the device.
Figure 3:
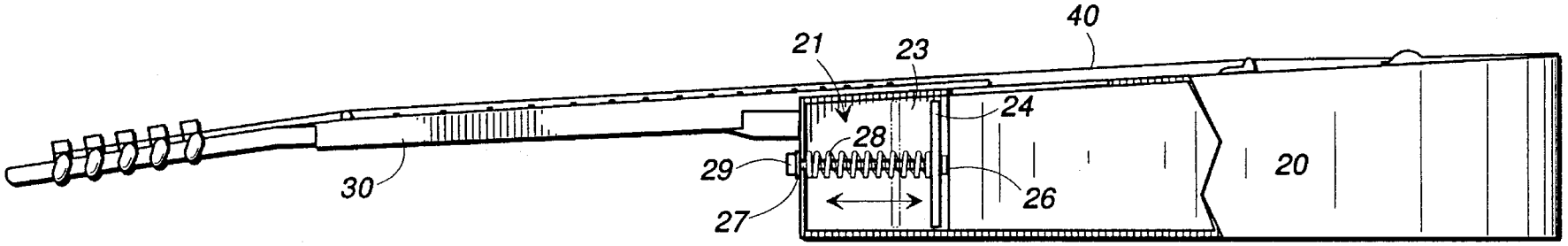
FIG. 3 is a side view, partially sectioned, of the embodiment of FIG. 1 showing the direction and movement of the adjustable tone box baffles of the device.

The tone box 20 is of standard classical guitar construction and dimensions but has been modified to include adjustable baffles 21 & 22 and an internal divider 23 as best seen in FIG. 2. The tone box baffles 21 & 22 are situated on either side of the internal divider 23 as shown and comprise a baffle plate 24 having a threaded sleeve 25, an elongated threaded member 26, such as a bolt, an adjustment means 29 with washer 27, and a spiral compression spring 28. The threaded sleeve 25 is centrally positioned within the baffle plate 24 for receiving threaded member 26. The adjustment means 29 is attached, at a point external to said tone box 20, to one end of said threaded member 26. As the threaded member 26 is turned, through the rotation of said adjustment means 29, the baffle 21 or 22 associated with said member 26 is caused to move laterally along the shaft of the member 26 depending on the direction the member 26 is turned. The compression spring 28 is positioned on the threaded member 26 between the washer 27 and the baffle plate 24 and serves to maintain the positioning of the baffle plates 24 within the tone box 20. The baffles 21 & 22 operate independent of each other and function to increase or decrease the volume of the area inside the tone box 20 as needed for adjusting the wavelength of the tones emitted from the tone box 20 to more closely coincide or align with the wavelength transmission ability of the ambient environment.

The fingerboard 30 is of sufficient width to accommodate a plurality of strings 40 and is of sufficient length to allow for a vibrational string length of 24⅛ inches for all said strings 40. Through experimentation, the inventor has determined that the optimal number of strings 40 required to produce and obtain maximum enhancement of musical overtones with this device 100 is ten (10) and that the optimal vibrational string length (from nut to bridge) is 24⅛ inches. It has also been determined, through experimentation, that under most conditions, tuning the instrument 100 to the key of Concert $A^b$ Major will generally provide optimum production, enhancement and transmission of the natural overtones produced by the device 100.

A string length of 24⅛ inches is used for all ten strings 40 of the invention and the exact string placement and diameter, as shown in the following chart, is essential to the enhancement of overtones produced by the device 100.

Key - $A^b$ Concert

| String # | Diameter | Classical Guitar Name | Tuning |
|---|---|---|---|
| 1 | .028" | E - 1st | $E^b$ |
| 2 | .028" | E - 1st | C |
| 3 | .040" | G - 3rd | $A^b$ |
| 4 | .040" | G - 3rd | G |
| 5 | .030" | D - 4th | $E^b$ |
| 6 | .030" | D - 4th | C |
| 7 | .034" or .037" | A - 5th | F |
| 8 | .030" | D - 4th | $D^b$ |
| 9 | .030" | D - 4th | $B^b$ |
| 10 | .034" or .037" | A - 5th | $A^b$ |

Through experimentation with this device 100, it has also been determined that, depending on ambient atmospheric conditions, one or more of the strings 40 will act as a secondary fine tuning string and can be utilized, if necessary, to further fine tune the instrument to achieve maximum production, enhancement and transmission of the natural overtones produced by the device 100. The particular string or strings which act as the secondary fine tuning string is subject to change depending on the environmental conditions (temperature, humidity, pressure, etc.) ambient at the time of play.

In the event ambient environmental conditions exceed the adjusting capability of the instrument as thus described, it may be necessary to retune, or reverse the order of, one or more strings 40 in order to compensate for these environmental changes. For instance, such additional adjustments may include the lowering of string #3 and/or string #4 by ½ step or 1 step respectively or it may include reversing the order of string #6 and #9 or reversing the order of string #8 and string #9. The inventor has found that in the event any of the strings are required to be reversed from the order shown in the above chart, the positioning of the tone box baffles 21 & 22 must be adjusted and in some cases reversed.

In order to achieve optimum production, enhancement and transmission of musical overtones with this instrument 100, a guitarist would first tune the strings 40 of the instrument 100 to the settings shown in the placement chart set forth in this specification. Depending on the key which produces the best resonance given the existing ambient conditions at the time of play, (usually this will be the key of Concert $A^b$ Major) the guitarist will then play a triad in the chosen key with strings #1, #2 and #3 of the instrument 100. Adjustments are then made to the tone box baffles 21 & 22 until the instrument 100 is fine tuned to ambient conditions and is producing the maximum vibration possible. Generally, the guitarist can "feel" when the instrument 100 has reached optimal vibration and hence optimal production, enhancement and transmission of overtones.

Further amplification of the enhanced overtones produced by this invention can be obtained by the use of standard transducer type pickup devices typically used with classical guitars and other acoustical instruments.

While the invention has been particularly shown and described with reference to the preferred embodiments thereof, it will be understood by those skilled in the art that various alterations in form, detail and construction may be made therein without departing from the spirit and scope of the invention.

The embodiments of the invention in which an exclusive property right or privilege is claimed are defined as follows:

1. An acoustical instrument designed to promote and enhance the production of musical overtones comprising:

a tone box having an internal divider means;

adjustable baffle means positioned within said tone box for adjusting the wavelength of tones emitted from said tone box;

an elongated fingerboard attached to said tone box; and, a plurality of strings of specific length, diameter and placement.

2. The apparatus of claim 1, wherein said fingerboard is of sufficient width to accommodate ten (10) strings and is of sufficient length to allow for a vibrational string length of 24⅛ inches.

3. The apparatus of claim 1, wherein the number of strings utilized with said instrument is ten (10).

4. The apparatus of claim 1, wherein the vibrational string length of said strings is 24⅛ inches.

5. The apparatus of claim 1, wherein the number of strings utilized with said instrument is ten (10) and said strings have the following specific diameters, order of placement and tuning:

| String # | Diameter | Tuning |
|---|---|---|
| 1 | .028" | $E^b$ |
| 2 | .028" | C |
| 3 | .040" | $A^b$ |
| 4 | .040" | G |
| 5 | .030" | $E^b$ |
| 6 | .030" | C |
| 7 | .034" or .037" | F |
| 8 | .030" | $D^b$ |
| 9 | .030" | $B^b$ |
| 10 | .034" or .037" | $A^b$. |

6. The apparatus of claim 1, wherein said instrument is tuned exclusively to the key of Concert $A^b$ Major.

7. The apparatus of claim 1, wherein said baffle means are situated on either side of said divider means, said baffle means further comprising a baffle plate for threadably receiving the shaft of an elongated threaded member, a spiral compression spring for maintaining the position of said baffle plate along the shaft of said threaded member, and a means for rotating said threaded member from a point external to said tone box.

8. The apparatus of claim 1, wherein said baffle means are moveably positioned on either side of said divider means and operate independently to increase or decrease the volume of the resonance area of said tone box.

9. An acoustical instrument designed to promote and enhance the production of musical overtones comprising:

a tone box having an internal divider means;

a pair of adjustable baffle means positioned within said tone box for increasing or decreasing the resonance volume of said tone box, each said baffle means comprising:

a baffle plate having a threaded sleeve centrally positioned thereon;

an elongated threaded member;

an adjustment means for rotating said threaded member; and, a spiral compression spring situated on said threaded member between said adjustment means and said baffle plate;

an elongated fingerboard of sufficient width to accommodate ten (10) strings and sufficient length to allow for a vibrational string length of 24⅛ inches; and, a plurality of strings of specific length, diameter and placement.

10. The apparatus of claim 9, wherein the number of strings utilized with said instrument is ten (10), the vibrational length of said strings is 24⅛ inches and the strings have the following specific diameters, order of placement and tuning:

| String # | Diameter | Tuning |
|---|---|---|
| 1 | .028" | $E^b$ |
| 2 | .028" | C |
| 3 | .040" | $A^b$ |
| 4 | .040" | G |
| 5 | .030" | $E^b$ |
| 6 | .030" | C |
| 7 | .034" or .037" | F |
| 8 | .030" | $D^b$ |
| 9 | .030" | $B^b$ |
| 10 | .034" or .037" | $A^b$. |

* * * * *